United States Patent [19]

Steele

[11] Patent Number: 4,715,539

[45] Date of Patent: Dec. 29, 1987

[54] HIGH-PRESSURE WATER JET TOOL AND SEAL

[76] Inventor: Curtis C. Steele, P.O. Box 44, Trenton, Ohio 45067

[21] Appl. No.: 940,299

[22] Filed: Dec. 11, 1986

[51] Int. Cl.[4] ..... B05B 3/02

[52] U.S. Cl. ..... 239/263; 239/259

[58] Field of Search ..... 239/263, 263.1, 263.2, 239/263.3, 259; 277/165, 169, 170, 171, 27; 384/130, 151, 477

[56] References Cited

U.S. PATENT DOCUMENTS

| | | | |
|---|---|---|---|
| 2,985,050 | 5/1961 | Schwacha | 83/53 |
| 3,532,014 | 10/1970 | Franz | 83/53 |
| 3,565,191 | 2/1971 | Bowen | 175/207 |
| 3,599,872 | 8/1971 | Guth | 239/259 |
| 3,986,523 | 10/1976 | Pacht | 239/443 |
| 3,987,963 | 10/1976 | Pacht | 239/124 |
| 4,081,200 | 3/1978 | Cheung | 239/172 |
| 4,369,850 | 1/1983 | Barker | 239/229 |
| 4,439,954 | 4/1984 | Bennett | 239/246 |
| 4,534,711 | 8/1985 | Wakatsuki | 417/273 |
| 4,690,325 | 9/1987 | Pacht | 239/124 |

*Primary Examiner*—Andres Kashnikow
*Assistant Examiner*—Karen B. Merritt

[57] ABSTRACT

A high-pressure water jet tool useful in removing paint, rust, scale and other deposits from various surfaces such as a metal tank, is described. The tool is equipped with a rotary nozzle head carrying at least one, and preferably three or more, very small water jet orifices. A seal of special design is used in the tool to connect the non-rotating section of the water supply line to the rotating section of the line which supplies water to the nozzle head.

9 Claims, 3 Drawing Figures

HIGH-PRESSURE WATER JET TOOL AND SEAL

BACKGROUND OF THE INVENTION

1. Field of the Invention

The present invention pertains to a high-pressure rotary-nozzle-head water jet tool suitable for removal of deposits such as scale, rust, paint and the like from various surfaces, and to the means for sealing the connection between the rotating section of the high-pressure water line and its non-rotating section. In particular, this invention pertains to an ultra-high-pressure rotary-nozzle-head water jet tool; such tools are operated at water jet pressures of 10,000 psi to 100,000 psi. An intensifier is used as auxiliary apparatus to achieve such water pressures.

2. Description of the Prior Art

Various high-pressure water jet tools have been described in the prior art. Representative of such tools are those described in the following patents; U.S. Pat. No. 2,985,050, B. G. Schwacha, water jet cutting of hard metals; U.S. Pat. No. 3,526,162 J. A. Wilcox, water jet cutting of rubber; U.S. Pat. No. 3,532,014, N. C. Franz, water jet cutting of cardboard; and U.S. Pat. No. 4,081,200 J. B. Cheung, water jet removal of structural concrete.

In the removal of rust, stripping of paint and similar operations where the operator moves the water jet tool across the work surface, it is highly advantageous to have a nozzle head which rotates in order to provide a wider path of impingement, thereby increasing the operating efficiency of the tool.

In the cutting of rock, drilling of holes and in mining operations employing high-pressure water jets, it is common practice to rotate the water jet head or nozzle. Examples of such are described in U.S. Pat. No. 3,565,191, J. T. Bowen and U.S. Pat. No. 4,369,850, Barker.

A major disadvantage of such rotary water jet tools, whether for rust and scale removal or in mining operations has been the lack of a practical seal for the connection between the non-rotating water supply pipe and the rotating section of the water supply line feeding the nozzle jets. Present ultra-high-pressure water jet tools are limited by the lack of seal means that can withstand the ultra-high-pressures.

Bowen (U.S. Pat. No. 3,565,191) attempts to overcome the problem by eliminating the necessity for ultra-high-pressure seals by rotating the intensifier with the hydraulic drill.

Barker (U.S. Pat. No. 4,369,850) resorts to the use of a section of flexible high-pressure hose connecting the nozzle head with the high-pressure water supply line. This permits the nozzle head to be rotated (orbited) without rotating the flexible hose; no seal is required.

The use of a rotating high-pressure water jet nozzle also is shown in U.S. Pat. No. 4,534,711 , M. Wakatsuki. The use of a seal between the non-rotating high-pressure water line entering the tool and the line feeding the water jets of the nozzle, is eliminated by the use of a section of flexible hose. The flexible hose does not, of itself, rotate, but the end of the hose orbits within the rotating nozzle head.

Water jet tools employing a flexible hose mounted to orbit within a rotating head or an eccentric rotor have the disadvantage that the flexible hose is very expensive because of its construction to withstand ultra-high pressures and has a limited service life. Moreover, replacement of a worn flexible hose requires dismanteling the front section of the tool, a time consuming operation which is expensive and results in loss of operating time.

A very real need exists for a seal that can operate effectively over long periods of operation at ultra-high pressures, that is, at water pressures of over 10,000 psi, not only for water jet tools but also for other ultra-high-pressure equipment.

SUMMARY OF THE INVENTION

It is an object of the present invention to provide a high-pressure rotary-nozzle-head water jet tool, (also referred to herein as a "rotary high-pressure water jet tool") capable of removing scale, rust and other deposits from metallic and non-metallic surfaces, which overcomes the deficiencies of other rotary high-pressure water jet tools.

It is also an object of this invention to provide a rotary high-pressure water jet tool which eliminates the need for a flexible hose section.

It is a further object of this invention to provide a seal means connecting the non-rotating high-pressure hydraulic supply line with a rotating hydraulic line, or tube, which seal has a long operating life and can be replaced very simply and quickly.

It is a particular object of this invention to provide a seal means connecting the non-rotating high-pressure water supply line with the rotating line, or tube, supplying the high-pressure water to a rotating head of a high-pressure water jet tool.

The present invention consists of a water jet tool with a high-pressure water supply line entering the rear of the tool, a cavity to receive a seal of a suitable low-coefficient of friction material, for example, ultra-high-molecular weight polypropylene, the seal being bored to receive the end of the water supply line and also to receive the end of the stem or tube of the rotating high-pressure line supplying the nozzle jets, the seal cavity being provided with a shoulder configuration to retain the seal against forward movement, means such as an air motor for rotating the nozzle jet supply line, means for attaching a nozzle head or a lance or wand of desired length, together with a nozzle head, and one or more jets mounted in the nozzle head. The seal member can be changed or replaced simply by unscrewing the nut which secures the high-pressure water supply line to the rear of the tool and then unscrewing the plug which closes the seal cavity; in a matter of a minute or two the seal cavity is opened, the worn seal material is removed (if necessary), a new seal material unit(s) is slipped into place, the plug is screwed in and the water supply line is re-connected. Normally the worn section of the seal material is left in place and augmented by one or more sections of the seal material placed in the seal cavity.

DESCRIPTION OF THE PREFERRED EMBODIMENT

Figure 1:
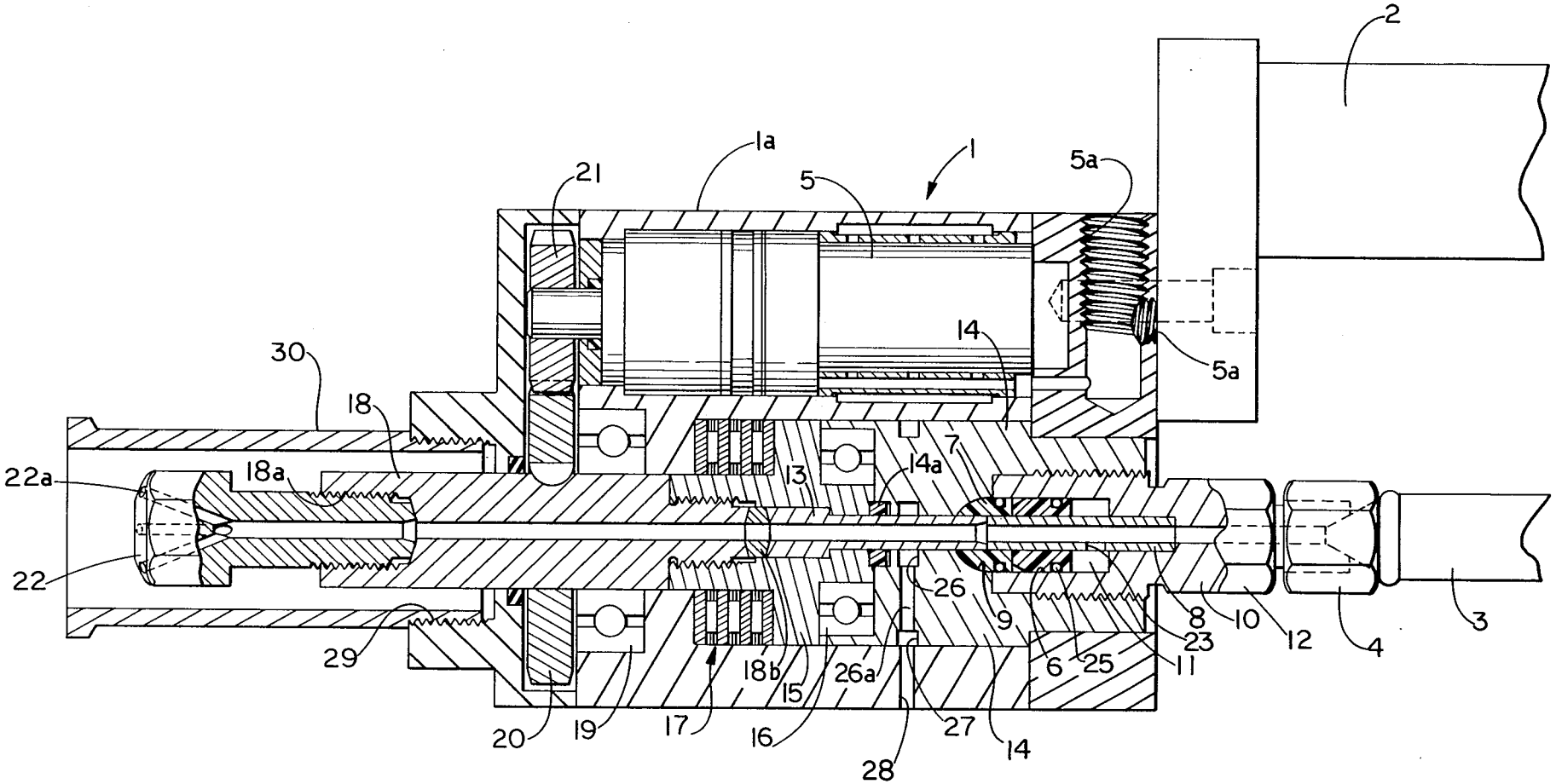
FIG. 1 is a side elevation of the preferred embodiment of the present invention.
Figure 2:
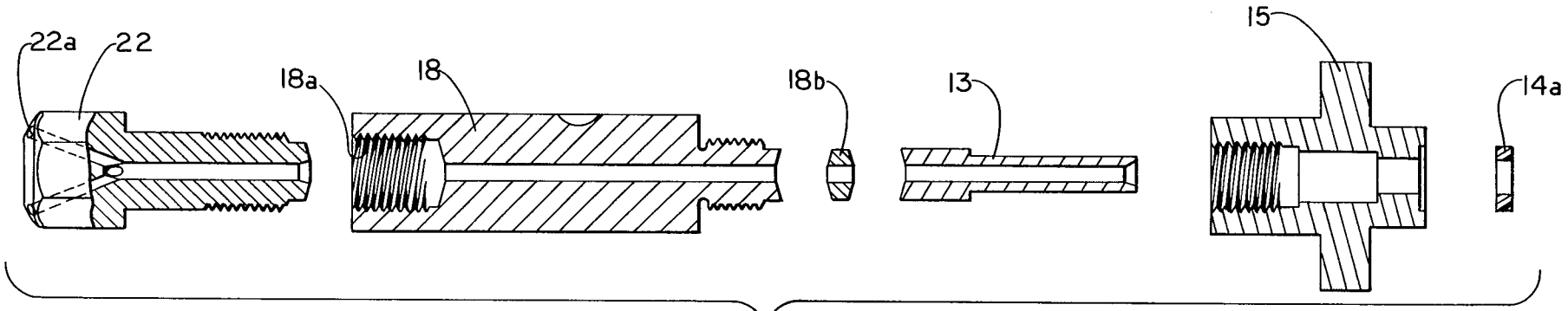
FIG. 2 is an exploded side elevation of the individual components of the rotating section of the rotary high-pressure water jet tool of the present invention.
Figure 3:
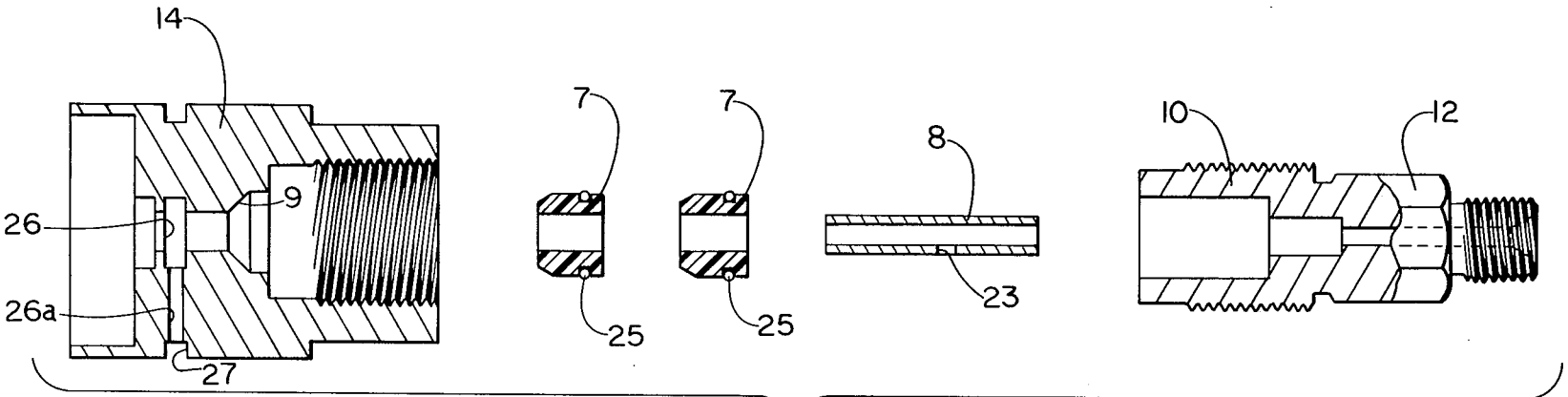
FIG. 3 is an exploded side elevation of the individual components of the non-rotating section and of the seal arrangement of the present invention.

Referring to FIG. 1 and also FIGS. 2 and 3, the water jet tool of my invention is generally referred to by the numeral 1; 1*a* indicates the housing of the tool and 2 indicates the rear handle. A high-pressure water supply line 3 fed by an intensifier (not shown) is connected to the rear end of the tool by nut 4. Air motor 5 is operated by pressurized air fed by air line 5*a*. Cavity 6 receives the seal material 7 which can be in one or more sections; shoulder 9 retains seal material 7 against forward movement. Numeral 8 indicates a tubular non-rotating water conduit; seal material 7 slips over this tubular conduit. Seal-holding plug 10 is in threaded engagment with block 14 and serves to close cavity 6; tubular conduit 8 is press fitted into plug 10. High-pressure water is leaked into a narrow annular space 11 behind seal material 7 from a small hole 23 in tubular conduit 8 at this point; this pressurized water in annular space 11 serves to force seal material 7 forward against shoulder 9 at all times the tool is in operation. Shoulder 9 can be rounded as in FIG. 1 or beveled as in FIG. 3. By means of integral hex-nut 12 seal-holding plug 10 can be screwed into place to close cavity 6 or can be unscrewed to remove it for re-loading.

The end of rotating tubular member 13 is inserted into the seal member 7 and abuts the end of non-rotating member 8; preferably member 13 is made of tungsten carbide to provide a long operating life. Block 14, internally threaded and preferably of brass, receives the threaded end of plug 10. Holder member 15, which receives rotating tubular member 13, fits into the recess in the forward face of block 14, the recess being provided with a suitable seal 14*a*; see FIGS. 2 and 3. Roller bearings 17 absorb the thrust of the high pressure of the water supply line. Member 18 screws into member 15 to retain in place rotating tubular member 13; brass washer 18*b* provides a seal between members 13 and 18. Threads 18*a* at the forward end of member 18 receive a nozzle head 22 or a nozzle head extension such as a wand or tube.

Members 12, 8, 13 and 18 form a conduit through which the high-pressure water flows from supply line 3 to nozzle head 22. Rotating members 13, 15 and 18 as well as nozzle head 22 are rotated by means of air motor 5 through gear 21 keyed on the motor shaft and gear 20 keyed on the member 18. Speed of rotation of the nozzle head is throttle controlled from zero to 2000 rpm, normally from 1500 to 2000 rpm. Ball bearings 19 as well as 16 serve as alignment bearings. Members 10 and 8 constitute the non-rotating portion; see FIG. 3.

Nozzle head 22 is equipped with one or more jets 22*a*; where more than one jet is provided the jets are set at an angle to the central axis. The nozzle head 22 is detachable so that various heads can be used on a single water jet tool. The nozzle head can be attached to a wand or shaft of desired length affixed to the end of member 18 so as to permit the operator to reach into vessels, deep cavities, long pipe sections etc. as may be needed. Detachable tubular member 30 serves as the front handle of the tool such as when an extension is attached at 18*a*.

The seal of my invention has the unique advantages of providing an excellent seal, long operating time and the facility of quick change. The cavity 6 for housing the seal material 7 instead of being only ¼" to ½" long can be an inch or more. As the ultra-high molecular weight plastic used as the seal material is worn away it is moved forward by the high-pressure of the water fed into the annular space 11 from the high-pressure water entering at opening 23, thereby providing a self-renewing sealing action. The seal material 7 is compressed around rotating tubular member 13 by virtue of the convergence of the forward wall (shoulder) 9 of the cavity toward the center line; the converging wall 9 can be of any suitable shape such as the semi-circular shape (FIG. 1) or beveled shape (FIG. 3). Thus, the seal material 7 is continuously supplied and is always held tight against the end of tubular members 8 and 13 where they abut. An excellent seal is secured even at pressures of 60,000 psi or more.

With my invention a substantial quantity of seal material can be placed in the cavity 6. FIG. 1 shows two of the seal material units 7 placed in the cavity 6. Alternatively, the cavity 6 can be designed to hold a single seal material unit 7 or several such units. Operating time of the water jet tool without changing or reloading the seal material has been greatly increased; with my invention instead of operating times of up to 25 to 30 hours the operator can run as many as five times that period before the necessity of a seal change or replenishment.

A special advantage of my invention is the ease of replacing the seal or reloading it. All that is required is to unscrew plug member 10 by means of a hex-nut 12, if necessary slipping the worn seal material unit off of tubular member 8, and then slipping one or more seal units 7 over the forward end of tubular member 8 leaving a part of member 8 not covered to provide the annular space 11. The seal of my invention is greatly simplified compared to the seals of the prior art; the water jet tool need not be disassembled other than the unscrewing of the two hex-nuts.

The seal material 7 suitable for my invention is a high-molecular-weight polymer, preferably an ultra-high molecular weight polymer, of the polyolefin family such as polypropylene and ethylene polypropylene, capable of withstanding high temperatures for example, 200° F. and above and capable of withstanding pressures of at least 10,000 psi. Such polymeric materials suitable for seals are known in the art.

As shown in FIG. 3 the seal material unit 7 is turned as a cylindrical piece with a bore of a few thousands of an inch larger than the diameter of tubular member 8 to facilitate sliding movement, and the leading edge is beveled or rounded, preferably beveled to an angle of about 35°. In one embodiment of my invention an annular groove 24 is provided to retain an O-ring 25. Due to the ultra-high pressures employed the O-ring is pressed into a thin layer which increases the sealing action against the wall of the cavity 6.

In one embodiment of my invention means is provided for a minute amount of leakage around the tubular member 13. A weep hole 26*a* leading from the annular groove 26 to an annular groove 27 permits a flow of a few drops of liquid to the outside of the housing through the opening 28. As the seal material 7 is slowly abraded away a milky suspension of the polymer particles in a small amount of water is formed. This suspension serves to lubricate the end of rotating tubular member 13 and prolong its life. The suspension moves forward along tubular member 13 to the annular groove 26 and weep hole 26*a* then to annular groove 27 and is discharged to the outside of the water jet tool through opening 25. The operator of the tool will be aware of this small discharge from the opening 28 in the housing and as long as it is milky he will know that the seal material unit 7 is still functioning and does not need to be replenished. The water jet tool can be operated without the weep hole or holes but the small amount of leakage will be eliminated; the life of tubular member 13 will be shortened due to the absence of the lubrication and the cooling effect of the suspension.

Inasmuch as a very high pressure is exerted upon rotating tubular member 13 at the point where the seal material 7 is compressed against the shoulder 9, a balance in pressure on the seal material 7 and on the member 13 must be secured. Too much pressure on tubular member 13 can create sufficient friction as to prevent member 13 and also members 15 and 18 from turning. Consequently tubular member 13 is inserted only a short distance, for example, ¼" or less, into the seal material unit 7. The seepage (leakage) of the water suspension of polymer particles along member 13, made possible by the weep hole 26*a*, annular grooves 26 and 27 and weep hole 28, serves to lubricate member 13 thereby facilitating the use of very high pressures at the seal.

A balancing of pressures is secured between the pressure of the water passing through tubular members 8 and 13 and the tendency to leak where members 8 and 13 abut on the one hand and the pressure of the water entering the annular space 11 on the other hand.

It is to be understood that the embodiments shown and described are the preferred ones and that many changes and modifications may be made thereto without departing from the spirit of the invention. Although the invention has been described with reference to high-pressure water systems, my seal means is applicable to other hydraulic systems such as brake fluids, cutting fluids and the like where the high pressure fluid passes from a non-rotating supply line to a rotating distribution line.

What I claim is:

1. Means for providing a seal between the end of a non-rotating section and the end of a rotating section of a high-pressure hydraulic supply line which comprises:
   - an axially aligned cavity holding a seal member, said cavity having a centrally positioned opening at its forward wall to receive said rotating section of said supply line,
     - said forward wall converging toward said central opening,
   - a plug member which forms the rear wall of said cavity, said plug member having a centrally positioned opening to receive said non-rotating section of said supply line,
   - said seal member having a centrally positioned bore,
   - said end of said rotating section and said end of said non-rotating section of said supply line being held in abutting alignment in said bore of said seal member, and
   - means for introducing high-pressure hydraulic fluid between the rear face of said seal member and the face of said plug member in said cavity to thereby force said seal member forward in said cavity against said converging wall of said cavity to thereby compress said seal member around said two ends of said supply line.

2. The seal means as claimed in claim 1 in which the seal member is a high molecular weight polymer.

3. The seal means as claimed in claim 1 in which the high-pressure hydraulic supply line is a high-pressure water line.

4. Means for providing a seal between the end of a non-rotating section and the end of a rotating section of a high-pressure water supply line, said two sections being axially aligned, which comprises,
   - an axially aligned cylindrically shaped cavity holding a seal member, said cavity having a centrally positioned opening in its forward end wall to receive said rotating section of said water supply line,
     - said forward end wall converging toward said opening,
   - a plug member which forms the rear end wall of said cavity, said plug member having a centrally positioned opening to receive said non-rotating section of said water supply line,
   - said seal member having a central bore
   - said end of said rotating section and said end of said non-rotating section of said water supply line being held in abutting alignment in said seal member,
   - an annular space between the rear face of said seal member and the face of said plug member, and
   - means for supplying high-pressure water from said water supply line into said annular space to thereby force said seal member forward in said cavity against said converging forward end wall of said cavity to thereby compress said seal member around said abutting ends of said water supply line sections.

5. The seal means as claimed in claim 4 wherein an annular groove is disposed about said rotating section of said water supply line forward of said seal member cavity, said annular groove being connected to a weep hole to thereby permit limited seepage of water forward from said seal cavity along said rotating section of said water supply line.

6. The seal means as claimed in claim 4 wherein said seal member is a cylindrically shaped unit composed of a high molecular weight polymer having a low coefficient of friction.

7. The seal means as claimed in claim 4 wherein said seal member is a shaped unit comprised of a high molecular weight polymer having a low coefficient of friction, said cavity housing one or more of said units.

8. A rotary-head high-pressure water jet tool comprising
   - a housing
   - a high-pressure water supply line extending through said housing and consisting of,
     - a non-rotating section connected to an external high-pressure water supply line,
     - a rotatable section, the rear end of which abuts the forward end of said non-rotating section, and
     - a nozzle jet head attached to the forward end of said rotatable section,
   - a seal-holding cavity concentric to said water supply line, the forward wall of said cavity converging toward the center thereof,
   - a centrally bored seal member held in said cavity and receiving the forward end of said non-rotating section and the rear end of said rotatable section in abutting alignment,
   - means for introducing water from said high-pressure water supply line into said cavity between the rear face of said seal member and the face of the rear wall of said cavity to thereby force said seal member forward against said forward wall of said cavity, and
   - means for rotating said rotatable section of said water supply line.

9. The high-pressure water jet tool as claimed in claim 8 wherein the means for rotating said rotatable section is an air motor.

* * * * *